US005368429A

United States Patent [19]

Young

[11] Patent Number: 5,368,429

[45] Date of Patent: Nov. 29, 1994

[54] PANEL LIFTING APPARATUS

[76] Inventor: Roland O. Young, Rte. 1, Box 138, Grand Forks, N. Dak. 58201

[21] Appl. No.: 18,120

[22] Filed: Feb. 17, 1993

Related U.S. Application Data

[63] Continuation of Ser. No. 692,602, Apr. 29, 1991, abandoned.

[51] Int. Cl.[5] ..... B66F 9/12

[52] U.S. Cl. ..... 414/11; 254/4 C; 254/6 C

[58] Field of Search ..... 414/10, 11; 254/3 C, 254/4 C, 4 R, 6 C, 7 C, 47, 102, 387, 903; 187/2, 9 F

[56] References Cited

U.S. PATENT DOCUMENTS

| | | | |
|---|---|---|---|
| 2,672,319 | 3/1954 | Nelson | 414/10 |
| 2,983,474 | 5/1961 | Hanna | 254/4 C |
| 3,261,589 | 7/1966 | Neumeier | 254/387 |
| 3,467,260 | 9/1969 | Thompson | 254/903 X |
| 3,828,942 | 8/1974 | Young | 417/11 |
| 3,861,647 | 1/1975 | Meredith | 254/4 R |
| 3,891,184 | 6/1975 | Fields | 254/387 X |
| 4,120,484 | 10/1978 | Zimmer | 254/6 C |
| 4,369,014 | 1/1983 | Jolivet | 414/11 |
| 4,508,316 | 4/1985 | Millard | 254/4 R |
| 4,600,348 | 7/1986 | Pettit | 414/11 |
| 4,768,754 | 9/1988 | Nishimura | 254/903 X |
| 5,078,364 | 1/1992 | Harrell | 254/387 |
| 5,127,791 | 7/1992 | Attman | 414/10 X |

*Primary Examiner*—Michael S. Huppert
*Assistant Examiner*—Scott L. Lowe
*Attorney, Agent, or Firm*—Robert E. Kleve

[57] ABSTRACT

The invention comprises a panel lifting apparatus having at least three telescoping elongated sections telescoping into one another and all telescoping into a non-telescoping elongated frame member. Three separate chain length segaments not directly connected to one another act to raise and lower the telescoping sections. The first chain segament has its upper and lower end mounted to the upper and lower end of the first telescoping section. The second chain segament has its upper end connected to the upper end of the non-telescoping section and its lower end connected to the lower end of the second telescoping section. The third chain segament has its upper end connected to the upper end of the first telescoping section and its lower end connected to the lower end of the third telescoping section. The non-telescoping section has a gear drive with its output gear engaging the first chain segament to raise and lower the first chain segament to thereby raise and lower the first telescoping section. The raising and lowering of the first telescoping section raises and lowers simultaneously the second and third telescoping sections through the chain segament connections.

2 Claims, 4 Drawing Sheets

FIG.8
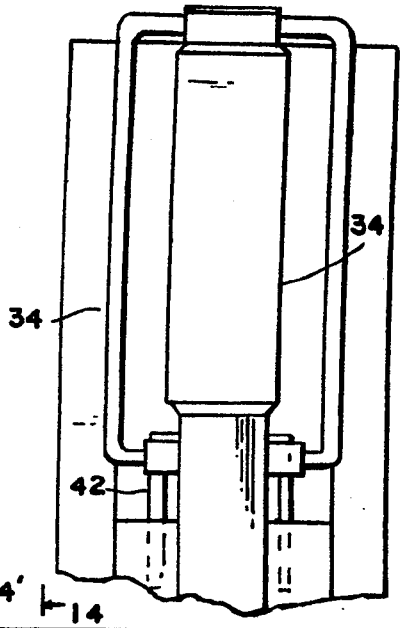
FIG.9
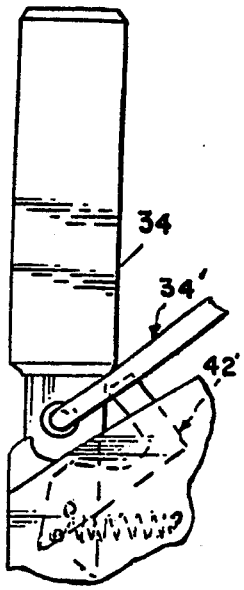
FIG.10
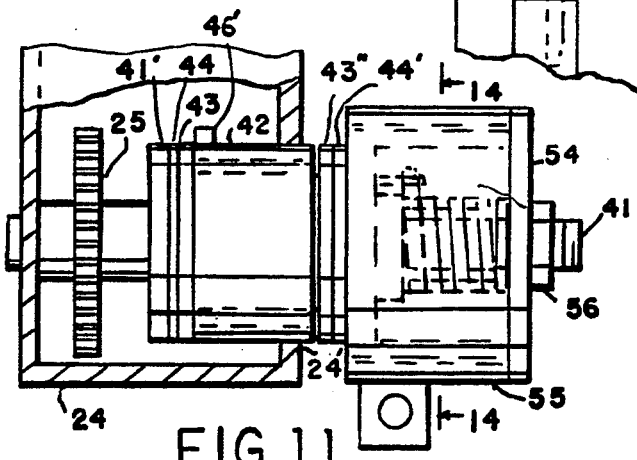
FIG.11
FIG.12
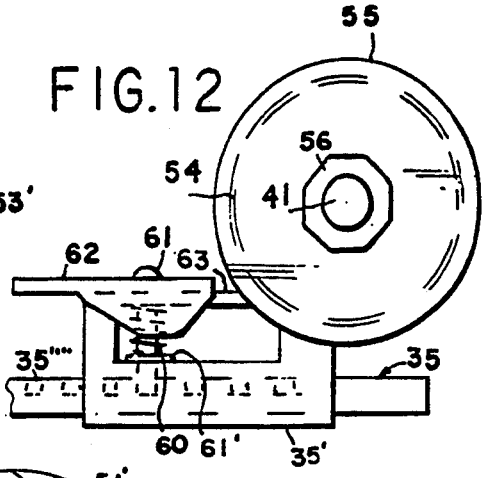
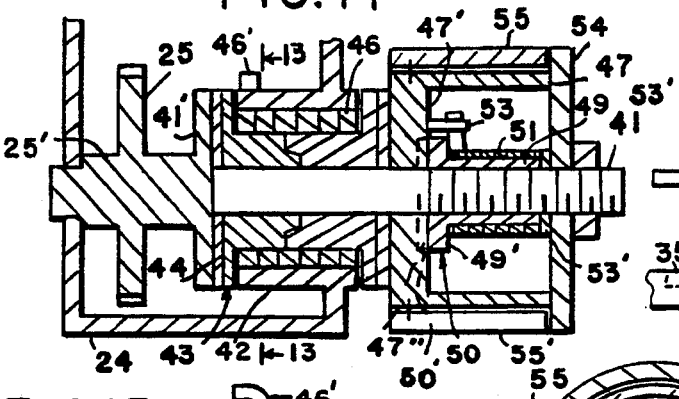
FIG.13
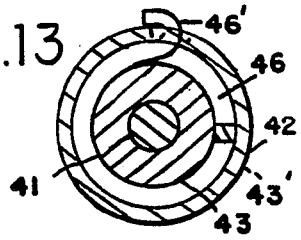
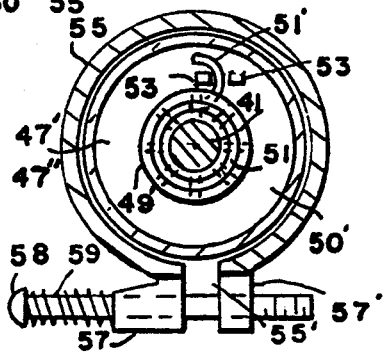
FIG.14

PANEL LIFTING APPARATUS

This application is a continuation of my earlier copending patent application U.S. Ser. No. 692,602, filed: Apr. 29, 1991, now abandoned.

BACKGROUND OF THE INVENTION

This invention relates to panel lifting apparatus. This invention is also related to my earlier U.S. Pat. No. 3,828,942.

It is an object of the invention to provide a novel panel lifting apparatus which has at least three telescoping sections raised by three separate lengths of chain connecting the sections together in a consecutive manner whereby raising one section causes the next section to be raised with drive means for driving the first length of chain.

It is a further object of the invention to provide a novel panel lifting apparatus for telescoping a plurality of sections by a chain driven mechanism.

Further objects and advantages of the invention will become apparent as the description proceeds and when taken in conjunction with the accompanying drawings wherein:

BRIEF DESCRIPTION OF THE DRAWINGS

FIG. 8 is a further enlarged end view of the drive box.

FIG. 9 is a cross-sectional view of the slip clutch drive and overload mechanism for operating the drive sprocket of the gear box.

FIG. 9 is an enlarged fragmentary side view of the latching mechanism for latching the bracing rod of the support handle with the rod removed from the latch.

FIG. 10 is an enlarged fragmentary side view of the latching mechanism for latching the bracing rod with the bracing rod shown mounted in the latching mechanism.

FIG. 11 is a cutaway view of the clutch mechanism similar to FIG. 9, with the mechanism cut away to reveal its interior construction.

FIG. 12 is a cross sectional view taken along line 12—12 of FIG. 9.

FIG. 13 is a cross sectional view taken along line 13—13 of FIG. 11.

FIG. 14 is a cross sectional view taken along line 14—14 of FIG. 11.

DESCRIPTION OF PREFERRED EMBODIMENT

Briefly stated, the invention comprises at least three telescoping sections with a first non telescoping section and a chain length for each telescoping section connecting the sections together in a series, whereby raising one of the sections relative to the non telescoping section raises the other sections simultaneously to the same amount. A panel lifting support is mounted to the top of uppermost section whereby the telescoping sections may be used to raise a panel positioned on the support. A gear drive is provided for driving the first chain length with said first chain length being connected at its end at locations at the upper and lower ends respectively of the first telescoping section with the gear drive at a location between said locations whereby rotating the gear drive drives the first chain to raise the first section, a slip clutch connection connects said gear drive to a handle whereby the handle will slip relative to the drive in the event of an overload on the sections exceeds the frictional connection between the slip clutch members, a safety brake mechanism is provided for the chain drive to the sections whereby the sections will retract only in reaction to the rotation of the handle and only as much as the handle is rotated.

Figures 1, 7:
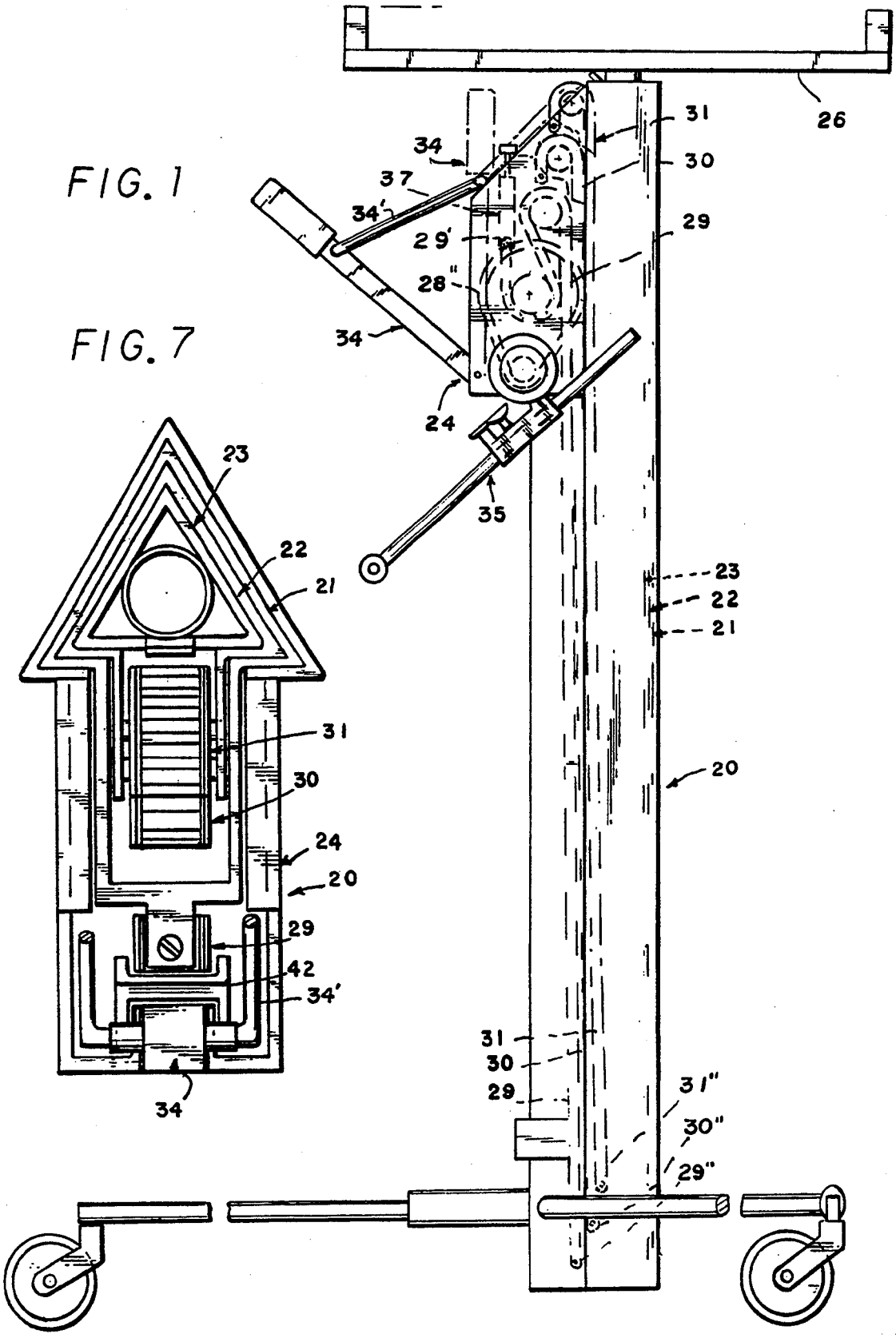
FIG. 1 is a side elevational view of the panel lifting apparatus.
FIG. 7 is an enlarged top view of telescoping sections and drive box and mechanism.
Figure 4:
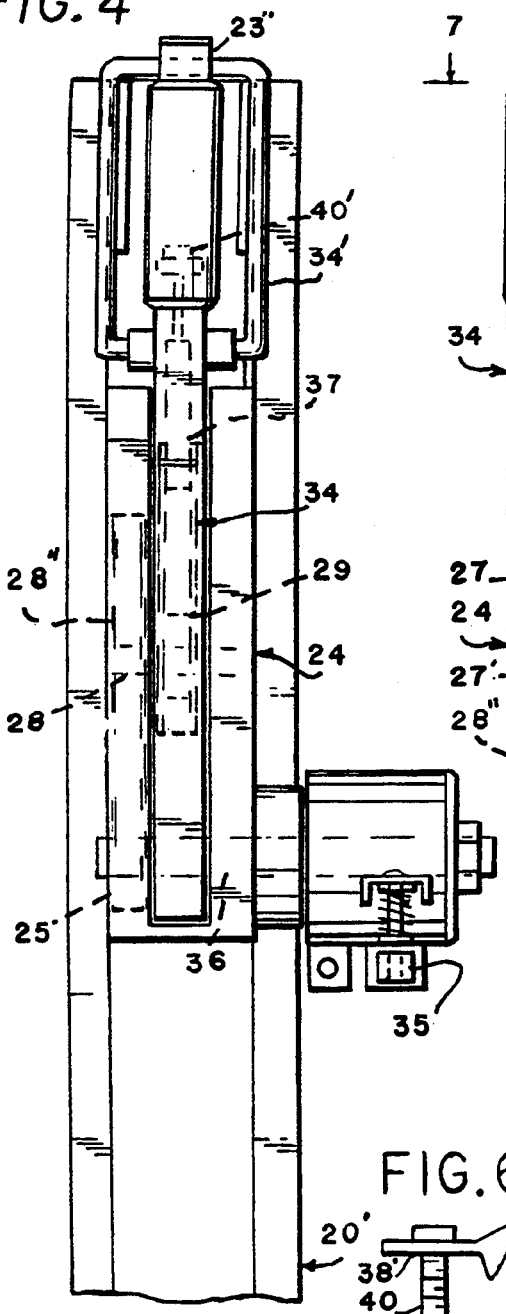
FIG. 4 is an enlarged end fragmentary end view of the telescoping sections and the handle operated drive mechanisms mounted in a box adjacent the sections.
Figure 2:
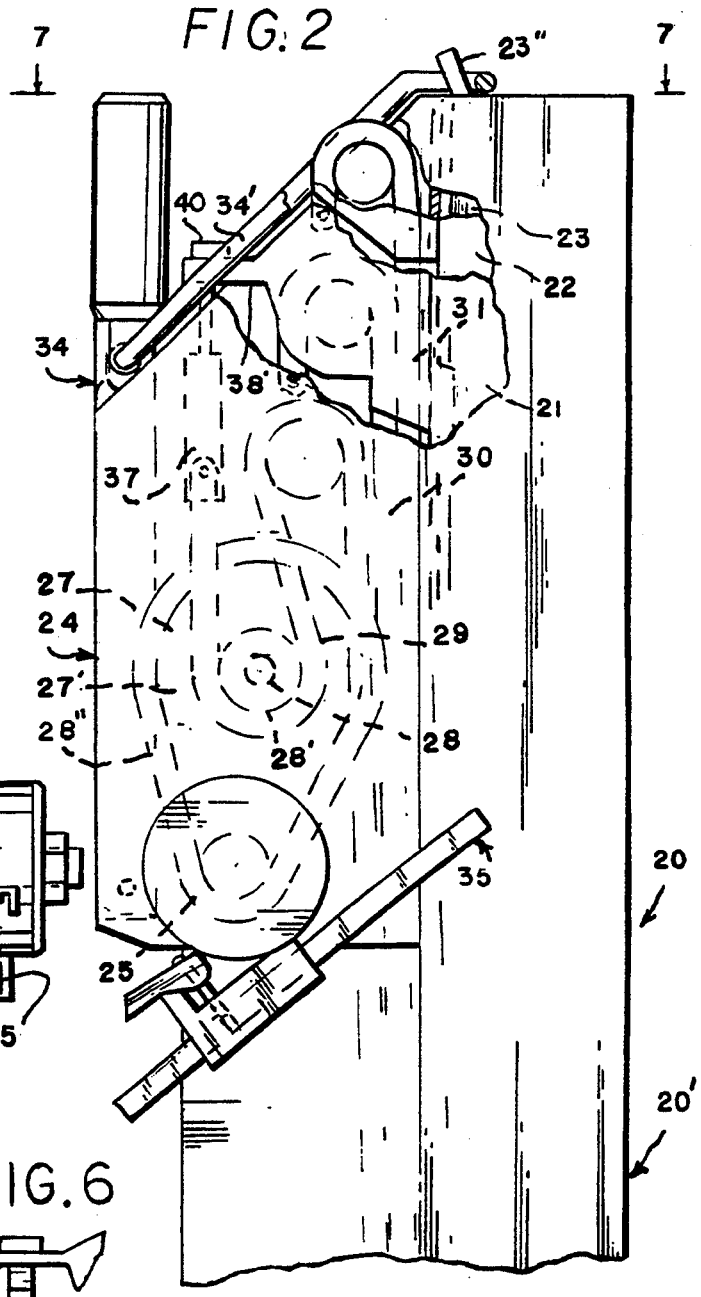
FIG. 2 is a fragmentary enlarged side elevational view of the telescoping sections and drive mechanism for telescoping the sections.
Figure 6:
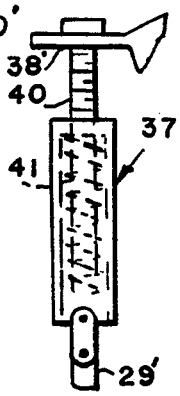
FIG. 6 is an enlarged side elevational view of the chain slack adjustment member.
Figure 5:
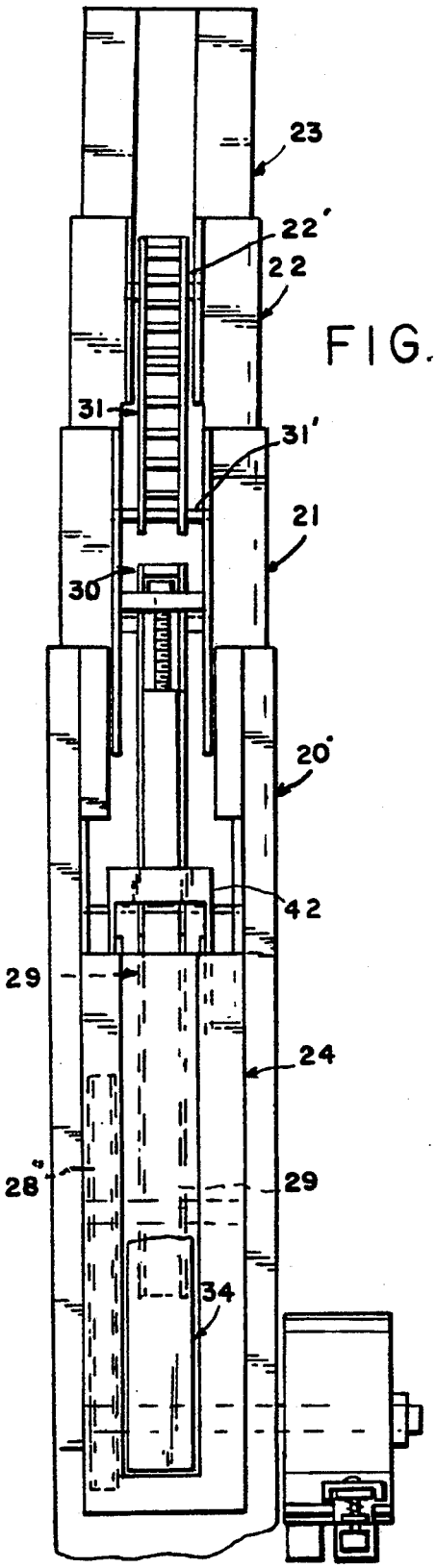
FIG. 5 is enlarged fragmentary side elevational view of the telescoping sections and drive mechanism similar to FIG. 1.
Figure 3:
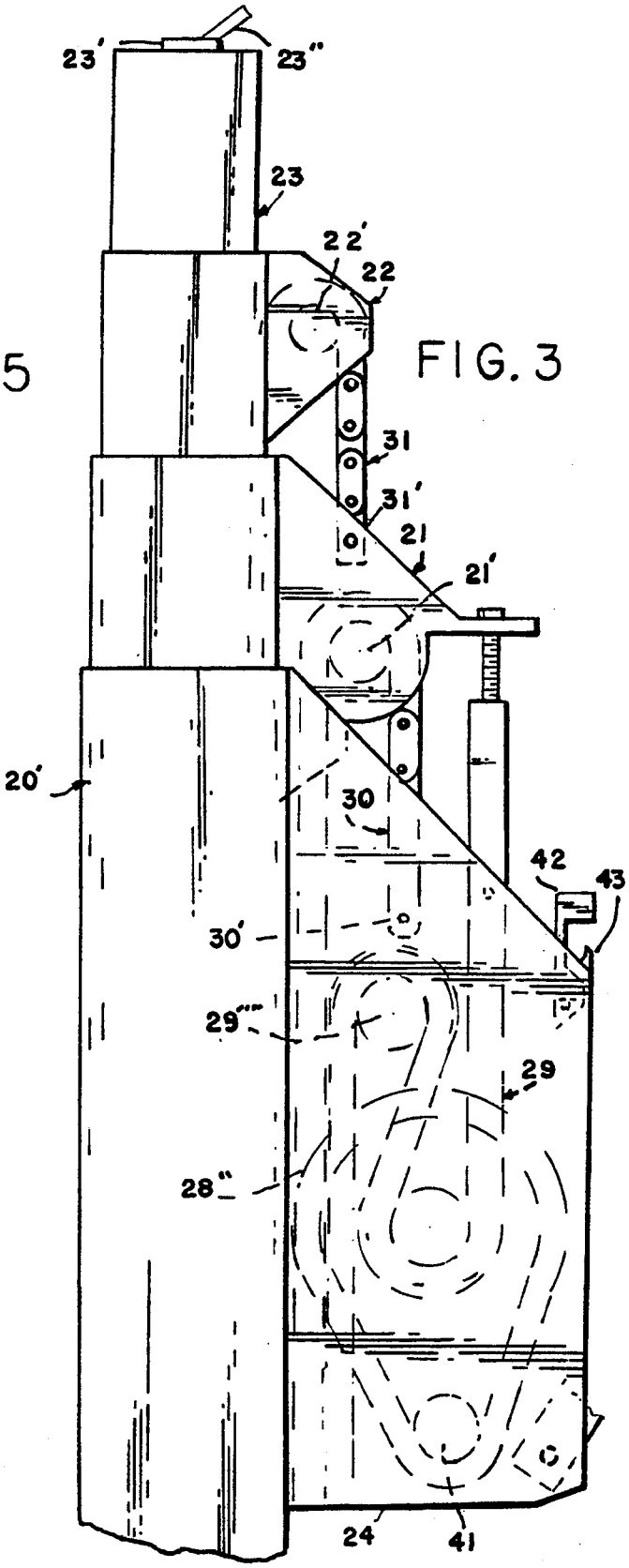
FIG. 3 is a fragmentary enlarged side elevational view of the panel lifting apparatus illustrating the sections partially telescoped from the opposite side of the mechanism.

Referring more particularly to the drawings, in FIG. 1, the panel lifting invention 20 is illustrated having a triangular elongated main frame channel member 20' with three elongated triangular channel members 21, 22, and 23, with each of the members 21, 22, and 23 slidably mounted in one another for telescoping movement upward from their position shown in FIG. 1.

A chain drive box 24 is mounted near the top of the main channel member 20'. The drive box 24 has a main sprocket gear 25 which is rotatably mounted in the drive box 24 and is rotated by rotation of the handle 35 through a slip clutch drive connecting the handle with the sprocket gear 25. A reduction gear 27 has a large sprocket gear 27' fixed to a shaft 28 and a small sprocket gear 28' fixed coaxially to shaft 28 and the shaft and its gears are rotatably mounted in the box 24 above gear 25. An endless chain 28'' drives the large sprocket 27' from gear 25, connecting the two gears together in driving relation. The rotation of the large reduction gear 27' rotates the small gear 28', which drives the first chain length 29. The chain length 29 has its upper end connected to the upper end 29' of channel member 21 and its lower end 29'' connected to the lower end of the same channel member 21. An idler roller 29''' is rotatably mounted in the box above gear 28' so as to wrap the chain 29 partially about gear 28' to maintain the gear 29 in driving engagement with gear 28' so as to be driven by gear 28'. A second chain length 30 has its lower end 30'' connected to the lower end of channel member 22 with its upper end 30' connected to the upper end of the main channel member 20' with an intermediate portion of the chain 30 wrapped about idler roller 21', rotatably mounted to channel member 21, so that raising the channel member 21 raises simultaneously channel member 22. A third chain length 31 has its lower end connected to sliding channel member 23 and its upper end connected to the upper end of channel member 21, with an intermediate portion of chain 31 wrapped about an idler roller 22', rotatably mounted to channel member 22, so that raising channel member 22 raises chain length 31 at its location about roller 22' thereby raising channel 23 relative to channel 22. The channel 23 has a tube mounting socket 23' fixed to its upper end and a conventional horizontally elongate panel supporting framework 24 has a tube 33' fixed to its center portion and slidably received in socket 23' to support the framework 24 on channel 23 whereby a panel mounted on frame work 24 is raised upward by the raising of the channels.

The chain drive box 25 has two handles 34 and 35. The handle 34 is pivotally mounted to the box 25 at pivot point 36 to pivot outward to provide stabilizing handle for stabilizing the device 20. The operator will grasp this handle with one hand while rotating handle 35 with his other hand to drive the chain drive to raise sections 21, 22, and 23 for raising dry wall panels and similar objects for installation in the ceiling for example, by placing the panel upon the cross framework 24 mounted to the top section 23.

The handle 34 has two positions, its operative stabilizing position shown in solid lines in FIG. 1 for stabilizing the device and its storage position shown in dashed lines in FIG. 1. The handle 34 when in its storage position serves to lock the sections 21, 22, and 23 in their retracted stored position shown in FIG. 1 by the pivotally mounted rod 34' of the handle being pivoted over the projecting lug 21' fixed to the top of section 21. Once the rod 34' has been positioned over the lug it locks the telescoping sections against telescoping for purposes of storage, and the pivotal angle of the handle and rod 34 and 34', when in the locked position, prevents the sections from telescoping upward even under the rotational drive of handle 35. When the handle 34 is pivoted outward to its operative position shown in solid lines in FIG. 1, the end 34'' of the rod 34 will be pushed against the front face 39 of lever 42 to pivot the lever 42 clockwise rearward to its position shown in solid lines in FIG. 11 and the end 34'' of the rod will be inserted in the notches 43 in the plate 43' fixed to the box beneath the lever and the lever may be pivoted counterclockwise over the top of the rod to lock the rod in the notches for locking the handle 34 in its operative position shown in solid lines in FIG. 1, for using the handle for steady the device while raising objects.

A spring operated chain length slack adjustment member 37 is connected between the upper end 29' of the first chain length and the upper end 38 of the channel or section 21 and serves to take up any slack in the chain to keep it taut after it has been driven past the drive gear 28 by the rotation of gear 28. The upper end 29' of the chain is pivotally mounted to the case 37' of the adjustment member 37. The case has an elongated hollow interior 37'' and a pin or screw 40 has its head 40' abutting a flange 38' fixed to the top of the channel member 21, and the screw is threaded in a bore in the flange 38' and passes freely through a bore in the case and extends down into the interior of the case. A spring 41 is mounted coaxially about the screw and a washer is fixed to the bottom of the screw and slidable within the interior of the case. The washer holds the spring in place on the screw with the spring in abutting relation against the top of the case urging the screw downward toward the gear 28 and urging the case upward to its position shown to keep the chain attached to the case taut. The pin or screw has a turnable head so that the screw, though it passes freely through the bore in the case by its threaded engagement with the flange 38' can be turned to thread the screw upward or downward to raise or lower the case and thereby the chain relative to section 21 to adjust the chain length end position relative to section 21 and gear 28.

The chain drive box 24 has two side panels 24' and 24'' with the shaft 27' of the reduction gear 27 and gear 28 fixed to these gears and rotatably mounted in the side panels 24' and 24'' of the box.

The main sprocket gear 25 has a shaft 25' which is rotatably mounted in panel 24' at its one end and the gear 25 is fixed to the shaft. A shaft portion 41 is fixed to the gear 25 at its other end and has an annular wall portion 41'. A sleeve 42 is fixed to the wall 24'. A friction washer 44 is freely fitted over the shaft to abut the wall portion 41'. A spool 43 is fitted over the shaft with one face of the spool 43' abutting the friction washer 41'. A coil spring 46 surrounds the spool, with one end 46' locked in a notch in the sleeve 42. A friction washer 44' is fitted against the other wall 43'' of the spool 43. A cylinder 47 has an end wall 47' fixed thereto with a center bore for the shaft 41 to extend therethrough and with the end wall abutting the washer 43'' at its one face. The shaft 41 is threaded along its one end portion 41' and a tube 49 having an inner threaded inner portion is threaded onto the shaft 41. The threaded tube 49 has an annular end wall portion 50 fixed thereto and the end wall portion 50 has annular radial ridges 50' along its outer face portion to engage complementary annular radial ridges 47'' in the end wall 47' of the cylinder, so that when the threaded tube 49 is rotated or screwed along the shaft 41 toward and against the end wall 47' of cylinder 47, the threading of the tube or sleeve against the end wall causes the sleeve's end wall to engage the cylinder end wall to lock together in non rotatable relation to one another. A coil spring 51 is fitted over the threaded sleeve with one end 51' engaged in a notch 53 in the end wall 47 to lock one end of the spring 51 to the end wall 47'. A washer 53 is fitted over shaft 41 in slightly spaced relation to the screw. An end wall 54 is fitted over the shaft and has a center bore to receive the shaft and the end wall 54 is fixed to the cylinder 55. A nut 56 is threaded onto the shaft 41 at its outer end to hold the end wall 54 on the shaft against the cylinder. The cylinder 55 has a slot 55' along its one edge and a pair of lugs 57 and 57' are fixed on edges of the cylinder 55 on opposite sides of the slot 55'. A threaded rod 58 is threaded into one lug with coil spring 59 mounted axially on the rod and engaging the head of the rod at one end and the lug 57 at the other end to urge the lug 57' toward lug 57 so as to frictionally engage cylinder 55 with cylinder 47. The handle 35 is fixed to sleeve or cylinder 55.

The spring 46, which surrounds the spool 43, cannot turn significantly either clockwise or counterclockwise, except to wind or unwind about the spool and is in constant frictional contact with the spool so that clockwise rotation of the spool can occur when turning the handle clockwise by the spool turning inside the spring and enlarging the spring by unwinding it. However, when the handle is turned counter clockwise, any frictional contact attempting to turn the spool by rotation of the handle only causes the spring to wind and tighten about the spool preventing any counterclock rotation of the spool; and thus the rotation of the handle only rotates the threaded tube away from the spool and allows slippage to occur of the gear to cause the retraction.

As the handle 35 is rotated counterclockwise, it moves the threaded tube away from the wall of cylinder 47 allowing slippage of the sprocket gear 25 to occur which allows the sections to retract under their own weight. As the sections retract, through the chain drive connection, and causes the sprocket gear to rotate, it rotates the shaft 41, which draws the threaded tube toward the wall of cylinder 47. The screw or tube 49 being engaged against the end wall 47' pushes cylinder 47 against washer 44', which is against the other wall 43'' of the spool, and thereby pushes the spool against the frictional washer 41' on the other side and the frictional washer against the wall of the sprocket gear 28, thereby locking the sprocket gear preventing further retraction of the sections 21, 22, and 23. In fact, the more the weight of the load attempts to lower the sections further, the more the threaded tube is drawn toward the wall further tightening the frictional lock against counter clockwise movement of the gear, under the weight of the sections.

Thus, the spring 46 provides a constant brake upon the spool against its counterclockwise rotation, so that the spool and gear cannot rotate in this direction and as result the sections cannot retract unless the handle 35 is itself separately being rotated counterclockwise. The weight of the sections and any load thereon cannot itself cause the handle to rotate counterclockwise or cause the sections to retract down significantly more than the separate handle 35 rotation would allow by its loosening the connection by rotation of the tube away from the wall, as the lowering of the sections causes the sprocket gear 25 to rotate counterclockwise which turns shaft 41, drawing the threaded tube 49 toward the wall of cylinder 47, and relocks the sprocket gear to the spool which spool cannot rotate counterclockwise, thereby stopping the counterclockwise rotation of the gear 28. Spring 46, by its engagement with the spool, prevents counterclockwise rotation of the spool thereby stops any further retraction unless the handle is rotated again which again allows slippage to occur of the gear counterclockwise relative to the spool.

The spring 58 serves as an overload release by engaging the handle 35 outer sleeve 55 to the inner sleeve or wall 47, so that the handle will turn the inner sleeve or wall 47 unless there is too much of a load on the telescoping sections, such as by their being blocked from going any higher when the operator has been turning the handle to raise them. In which case, the spring 58 will allow the outer sleeve 55 to spread apart slightly and the handle will then slip on cylinder 47 and not rotate the inner sleeve or wall 47.

When rotating the handle counterclockwise to lower the sections, the handle rotates the sleeve 55, rotating the cylinder 47 and cylinder wall 47'. The wall 47' rotates the the spring 49. Through the serrated connection between the cylinder wall 47' and the end flange of the threaded tube 49, the end wall causes the rotation initially of the thread tube on the shaft 41 away from the wall 47' sufficiently to loosen the frictional connection. The depth axially of the overlapping interconnections of the notch in the wall 47' and flange of the threaded tube must be sufficient to form a positive drive connection initially between the cylinder wall and the flange of the tube that is long enough to cause the rotation of the tube with the wall long enough to sufficiently unfreeze the tightness of the connection caused by the threaded tube flange against the wall 47'; so that, thereafter, the frictional connection between the spring 51 and the threaded tube will provide sufficient friction thereafter to cause the tube to rotate with the rotating of the spring when rotating the handle, so that further rotation of the handle 35 counterclockwise will thread the threaded tube on the shaft further away from the spool and the frictional washers. The notches or grooves and ridges sufficient overlapping depth to them to assure that the counterclockwise rotation of the handle and wall 47' will not simply rotate the spring on the threaded tube by the wall rotation without rotating the threaded tube, since without rotating the threaded tube there would be no loosening of the connection.

The length of the rod 35'', with respect to the center axis of the shaft 41, can be adjusted or varied. The handle 35 has a mounting post 35' which is fixed to the sleeve 55, and a slidably adjustable rectangular rod 35'' is slidably mounted in a square slot in the post 35'. A coil spring 60 is mounted coaxially over a pin 61. The pin 61 is slidably mounted in a bore in the post and the spring has one end engaging the ledge 63 of the post and the other end engaging the annular projecting lip 61' of the pin to urge to the pin downward in the bore in the post to engage against the rod 35''. The square rod 35'' has a plurality of spaced bores of a size to receive the pin and to lock the pin in engagement with the rod and thereby lock the rod in an adjusted position with respect to the center axis of the shaft 41.

When it is desired to lengthen the rod, with respect to the center axis of the shaft 41, the operator will pivot the lever 62 upward from its position shown in solid lines, with respect to the post 35'. Since the lever 62 has a bore large enough to slidably receive the stem of the pin 61, but smaller than the head of the pin, the raising of the lever 62 will cause the lever to engage the head of the pin 61 and raise the pin out of one of the bores 35'''' in the rod, so that the rod can slid along the square opening in the post to the left from its position shown in FIG. 1, to thereby lengthen the effective length of the rod as a handle with respect to the shaft 41. The rod will be slid to place a selected another one of the bores 35'''' in alignment with the pin 61, whereupon the operator can release the lever 62 allowing it to drop back down so that the pin under the urging of the spring can drop down into the selected one of the bores to lock the rod in its adjusted position.

Operation

The panel lifting device 20 operates as follows:

The operator will, with the panel support member 36 removed from the socket 21' at the top of channel member 21, detach the rod 34' from the projecting lug 21'' by pivoting it counterclockwise over the lug and then pivot the handle 34 counterclockwise from its position shown in phantom lines mounted over lug 21'' to its position shown in solid lines in FIG. 1 and will engage the end 34'' of the rod against the front face 39 of plate 42 and pivot the plate 42 clockwise from its position shown in FIG. 10 without the end of the rod 34' mounted therein to its position shown in FIG. 10 in phantom pivoting the plate 42 clockwise backward and enabling the rod 34' to engage the end 34'' of the rod in the notches 43. Whereupon the plate 42 will under spring urging be clear of the rod 34' and pivot back to its position as shown in FIG. 11 with the end 34'' of the rod in the notches as shown and being locked in the notches by the backward counterclockwise pivoting action of the plate 43. This locks the rod 34' in its position shown in solid lines in FIG. 1 so that the handle 34 is also locked in its position shown in solid in FIG. 1, so that the operator may use the handle 34 to hold the device still while operating the handle 35 with his other hand.

The operator will place a conventional dry wall panel upon the conventional panel support member 36 mounted to the innermost channel section 23 when it is desired to raise the dry wall panel to a ceiling for example to install the panel in the ceiling. The panel lifting device will be rolled on the floor to its desired position beneath the portion of the ceiling the operator wishes to install the dry wall panel.

To raise the panel support member 24, with the dry wall panel thereon; the operator will rotate the handle 35 clockwise, when viewed from FIG. 1, and the sleeve 55, to which handle 35 is fixed, will rotate clockwise. Sleeve 55 coaxially surrounds the cylinder 47. Sleeve 55 is separated at slot 55' and spring 58 urges the sleeve portions of sleeve 55 on opposite sides of the slot 55' to flex toward one another and frictionally engage with its inner surfaces the outer surfaces of cylinder 47 to rotate cylinder 47 clockwise with the cylinder as it rotates. The rotation of cylinder 47 clockwise winds and contracts the spring 51 about the screw or threaded tube 49, spring 51 having one end engaged in notch 53 of cylinder 47 so as to rotate with the cylinder while its other end 51'' is free. Spring 51 is in constant though slipping frictional contact with the tube; which frictional contact is sufficient to cause the spring to drag and contract about the screw or tube until the spring freezes with the tube and the tube rotates with the spring, the cylinder 47, sleeve 55 and handle. The rotation of screw or tube 49, through its threaded engagement with the shaft 41, causes the tube to thread along the shaft toward end wall 47' of cylinder 47 until the complementary ridges 50' and 47'' of the tube and cylinder engage and lock the cylinder and screw or tube together, so that they move together axially along the shaft toward the gear 2 as well as rotate together. The tube, in moving along the shaft, will move the cylinder 47 toward the frictional washer 44' and cause the end of wall 47 to engage against washer 44'. This causes washer 44', in turn, to engage against one wall of the spool, moving the spool against the other washer 44 along the other side of the spool. The frictional washer 44, in turn, is moved against the wall 41', fixed to shaft 41, and frictionally locks the wall, shaft and its sprocket gear 25, fixed thereto, together with the frictional washers, spool, screw, spring 51, cylinder 47 and its wall, sleeve 55, and handle 35, so that rotation of the handle 35, by its clockwise rotation, rotates the sprocket gear 25 to drive the endless chain 28'', which drives the reduction gear 27 with the small gear 27' of the reduction gear driving the length of chain 29, which raises the section 21.

The raising of section 21 simultaneously raises section 22, through the chain connection 30, which simultaneously raises section 23 through chain length connection 31, and the raising of section 30 raises the panel support 24 mounted thereon and the panel thereon. The handle will continue to be rotated clockwise raising and telescoping the sections until the dry wall panel thereon reaches the ceiling, assuming the height of the ceiling is less than the telescoping height of the sections 21, 22, and 23. The sections 21, 22, and 23 will telescope relative to one another until approximately 85–90 percent of the length of each section has been telescoped out of its outer adjacent section, although this percentage may vary. The section 21 can telescope upward out of section 20' for approximately the 85–90 percent of the section 21, section 22 can telescope out of section 21 for a similar percent of its length, and the same for section 23. A suitable stop, not shown, is provided at the bottom of section 21 which can engage a cooperating stop at the bottom of the box 25 or nearby, to stop the upward movement of section 21, relative to the stationary section 21' at the approximate 85–90 percent telescoping extension. The stopping of section 21, stops sections 22 and 23 in a similar telescoped position, which is the upper limit of the telescoping action of sections 21, 22, and 23 for raising a panel.

To lower the panel and/or support structure 24, the handle 35 will be rotated in the opposite direction.

The sections 21, 22, and 23 will lower only as the handle 35 is rotated counterclockwise when viewed from FIG. 1, as the counterclockwise movement of the handle acts to, first, rotate the screw or threaded tube 49 counterclockwise which moves the screw along the shaft away from the washers, sprocket gear and spool allowing sufficient slippage between the frictional washers for the sprocket gear 25 to slip and rotate counterclockwise under the weight of the sections and any load thereon which rotates the shaft 41 which draws the threaded tube back toward the sprocket, washer, and spool relocking them in with sufficient frictional engagement with one another to stop the counterrotation of the sprocket and resulting lowering of the sections, so that as a result the sprocket gear only rotates the amount of distance arcuately the handle 35 rotates before the reaction of the lowering of the sections in rotating the shaft relocks the sections against downward movement.

When the handle 35 is rotated clockwise to raise the sections, the spool rotates within the spring 46, and the spool rotates because of its frictional engagement at its ends with the washer with its rotation transmitting the drive of the handle to the sprocket gear 25.

When handle 35 is rotated counterclockwise, lowering the section spring 46 keeps the sections 21, 22, and 23 from dropping down or retracting unless the handle 35 is rotated and then only to the amount arcuately the handle is rotated. The spring engages the spool and prevents the spool from rotating counterclockwise, when prevents the sections from rotating the handle under simply the force of their weight by any direct drive, consequently the lowering of the sections must come from the rotation of the handle counterclockwise, as when the handle 35 is rotated counterclockwise, the friction between the spool and the shaft through the frictional washers is loosened so that the shaft may rotate separately of the spool to lower the sections, but in rotating counterclockwise, it draws the threaded tube toward the spool, sprocket, and washers and relocks the sections from further movement beyond that allowed by the movement of the handle in loosening the connection.

Thus, it will be seen that a novel panel lifting device has been provided which operates to telescope at least three sections by means of separate lengths of chain, and which provides novel braking action against the sections unintentionally dropping downward when the drive handle is not being rotated.

It will be obvious that various changes and departures may be made to the invention without departing from the spirit and scope thereof, and accordingly, it is not intended that the invention be limited to that specifically described in the specification or as illustrated in the drawings but only as set forth in the appended claims, wherein:

I claim:

1. A panel lifting device comprising:

first, second, and third elongated telescoping support sections, each having an upper and a lower end;

first, second, and third, separate, disconnected chains, one for each of the telescoping sections, each having an upper and a lower end;

an elongated non-telescoping section receiving said first telescoping section in a telescoping fashion; and a panel support mounted to the upper end of the third telescoping section for supporting a panel thereon; wherein said first chain has its upper and lower ends, respectively, connected to the upper and lower ends of the first telescoping sections;

said second chain has its upper end connected to the upper end of the non-telescoping section and its lower end connected to the lower end of the second telescoping section;

said third chain has its upper end connected to the upper end of the first telescoping section and its lower end connected to the lower end of the third telescoping section;

a first idler gear is rotatably mounted to the first telescoping section adjacent its upper end, said second chain has it upper end encircling over the top of said first idler gear whereby raising of said first telescoping section raises said first idler gear which raises the lower end of the second chain thereby raising the second telescoping section;

a second idler gear is rotatably mounted to the second telescoping section adjacent its upper end, said third chain has its upper end encircling over the top of said second idler gear whereby raising said second telescoping section raises said second idler gear which raises the lower end of the third chain thereby raising the third telescoping section; and drive means for engaging and driving said first chain to raise said first telescoping section and thus correspondingly raising said second and third telescoping sections.

2. A panel lifting device comprising:

first, second, and third elongated telescoping support sections, each having an upper and a lower end;

first, second, and third separate, disconnected chains, one for each of the telescoping sections, each having an upper and a lower end:

an elongated non-telescoping section receiving said first telescoping section in a telescoping fashion; and a panel support mounted to the upper end of the third telescoping section for supporting a panel thereon; wherein said first chain has its upper and lower ends, respectively, connected to the upper and lower ends of the first telescoping sections;

said second chain has its upper end connected to the upper end of the non-telescoping section and its lower end connected to the lower end of the second telescoping section;

said third chain has its upper end connected to the upper end of the first telescoping section and its lower end connected to the lower end of the third telescoping section;

a first idler gear is rotatably mounted to the first telescoping section adjacent its upper end, said second chain has its upper end encircling over the top of said first idler gear whereby raising of said first telescoping section raises said first idler gear which raises the lower end of the second chain thereby raising the second telescoping section;

a second idler gear is rotatably mounted to the second telescoping section adjacent its upper end, said third chain has its upper end encircling over the top of said second idler gear whereby raising said second telescoping section raises said second idler gear which raises the lower end of the third chain thereby raising the third telescoping section;

a gear drive is mounted to said non-telescoping section for engaging and driving said first chain to raise said first telescoping section and thus correspondingly raising said second and third telescoping sections;

a rotary handle drives said gear drive for raising and lowering said telescoping sections during operation;

said gear drive including a slip clutch whereby said rotary handle will slip relative to said gear drive in the event of an overload being applied to said rotary handle during operation; and said gear drive further includes a safety brake mechanism having limiting means limiting the retraction of the telescoping sections whereby the telescoping sections will only retract in reaction to and in proportion to the rotation of the rotary handle.

* * * * *